US006945033B2

(12) United States Patent
Sealy et al.

(10) Patent No.: US 6,945,033 B2
(45) Date of Patent: Sep. 20, 2005

(54) CATALYST PRECONDITIONING METHOD AND SYSTEM

(75) Inventors: Brent Edward Sealy, Dearborn, MI (US); Donald James Lewis, Howell, MI (US); Kenneth John Behr, Farmington Hills, MI (US); Thomas Raymond Culbertson, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 171 days.

(21) Appl. No.: 10/604,100

(22) Filed: Jun. 26, 2003

(65) Prior Publication Data

US 2004/0261402 A1 Dec. 30, 2004

(51) Int. Cl.[7] ..... F01N 3/00

(52) U.S. Cl. ..... 60/285; 60/274; 60/276; 60/297; 123/103; 123/109

(58) Field of Search ..... 60/274, 276, 285, 60/295, 297, 301; 701/103, 109, 104

(56) References Cited

U.S. PATENT DOCUMENTS 4,167,924 A 9/1979 Carlson et al.
4,169,440 A 10/1979 Taplin et al.
4,364,358 A 12/1982 Shikata et al.
4,733,358 A 3/1988 Abthoff et al.
4,809,501 A 3/1989 Kayanuma et al.
5,253,632 A 10/1993 Brooks
5,282,360 A 2/1994 Hamburg et al.
5,475,975 A * 12/1995 Nasu ..... 60/276
5,544,639 A * 8/1996 Shouda et al. ..... 123/676
5,740,669 A * 4/1998 Kinugasa et al. ..... 60/285
6,032,461 A * 3/2000 Kinugasa et al. ..... 60/295
6,370,872 B1 * 4/2002 Watanabe et al. ..... 60/288
6,453,661 B1 9/2002 Lewis et al.
6,453,662 B1 9/2002 Lewis et al.
6,470,675 B1 10/2002 Lewis et al.

* cited by examiner

*Primary Examiner*—Binh Q. Tran
(74) *Attorney, Agent, or Firm*—Donald J. Lewis; Allan J. Lippa

(57) ABSTRACT

Method and system for controlling an internal combustion engine of a vehicle where a catalyst is communicated to engine exhaust gases including predicting occurrence of an impending engine operating event that will change an exhaust constituent in the engine exhaust gases, determining an oxygen content of exhaust gases downstream of the catalyst, and adjusting an air-fuel ratio of the engine based on the determined oxygen content and the predicted engine operating event to precondition the catalyst prior to occurrence of the particular event.

16 Claims, 7 Drawing Sheets

| VEGOn2 | INDICATED LAMBDA | | | | |
|---|---|---|---|---|---|
| 0 | 1.05 | 1.05 | 1.05 | 1.05 | 1.05 |
| 0.1 | 1.05 | 1.05 | 1.05 | 1.05 | 1.05 |
| 0.2 | 1.02 | 1.02 | 1.02 | 1.02 | 1.02 |
| 0.4 | 1.01 | 1.009 | 1.008 | 1.005 | 1.003 |
| 0.45 | 1.008 | 1.006 | 1.004 | 1.003 | 1.001 |
| 0.5 | 1.006 | 1.003 | 1.002 | 1.001 | 0.999 |
| 0.55 | 1.005 | 1.002 | 1.001 | 0.999 | 0.997 |
| 0.6 | 1.004 | 1.001 | 1 | 0.998 | 0.995 |
| 0.65 | 1.002 | 1 | 0.997 | 0.995 | 0.99 |
| 0.7 | 1 | 0.998 | 0.995 | 0.99 | 0.95 |
| 0.9 | 0.95 | 0.95 | 0.95 | 0.95 | 0.95 |
| | 500 | 562 | 842 | 1112 | 1562 |
| | EXT_REG | | | | |

FIG. 5

LEAN
RICH
1.0
LEAN BIAS
RICH BIAS
TIME

RPM
TIPIN
TIME

VEHICLE SPEED
TIPIN
0 MPH
TIME

CATALYST TEMP
TIME

THROTTLE POSITION

ENGINE OUT $NO_x$

TAIL PIPE $NO_x$ EMISSIONS WITHOUT COMPENSATION

TAIL PIPE $NO_x$ EMISSIONS WITH COMPENSATION

CATALYST PRECONDITIONING METHOD AND SYSTEM

BACKGROUND OF INVENTION

1. Field of the Invention

The present invention relates to a method and control system for adjusting air/fuel ratio in cylinders of an internal combustion engine in anticipation of an impending engine event that will change exhaust emissions to precondition a catalyst in a manner to reduce emissions when the event subsequently occurs.

2. Description of Related Art

To reduce emissions, such as NOx, HC, and CO, modern automotive vehicles typically include an emission control system coupled to the engine of the vehicle. For example, many vehicles are equipped with a three-way catalytic converter, which includes a catalyst material capable of storing oxygen and NOx (oxidants) during periods when the engine is operated with a lean air/fuel ratio and of releasing stored oxygen and NOx for reaction with HC and CO (reductants) produced by the engine during periods when the engine is operated with a rich air/fuel ratio. In this way, the emission of both oxidants (NOx) and reductants (HC and CO) into the atmosphere is reduced.

Most emission control systems are employed in connection with an engine air/fuel ratio control strategy that monitors and adjusts the air/fuel ratio provided to the engine cylinders in order to increase the emission reduction capability of the catalyst. The air/fuel strategy typically attempts to maintain the engine at stoichiometry (or other preselected desired air/fuel ratio) and relies on air/fuel feedback from one or more exhaust gas oxygen sensors. For example, it is known to position a pre-catalyst exhaust gas oxygen sensor upstream of the catalytic converter and a post-catalyst exhaust gas oxygen sensor downstream thereof. The output signals from the pre-catalyst and post-catalyst exhaust gas oxygen sensors are each compared to a respective set point reference value to calculate a pre-catalyst error value and a post-catalyst error value. The error values are generally indicative of whether the air/fuel ratio at the point of the respective exhaust gas oxygen sensor is rich or lean relative to stoichiometry. An electronic engine controller adjusts an amount of fuel provided to the engine cylinders, and thus the air/fuel ratio therein, based at least in part on the pre-catalyst and post-catalyst error values.

However, conventional air/fuel ratio control strategies do not attempt to anticipate a future engine operating event that may lead to unwanted emissions. For example, conventional air/fuel ratio control strategies do not attempt to anticipate a so-called impending engine tip-in operating event that increases engine loads (e.g. vehicle acceleration from stop or near stop) where elevated NOx concentrations are present in the engine exhaust gas as a result of increased in-cylinder gas temperature and pressure. If the emission control system waits to actually observe and then counter the tip-in operating event by providing a rich air/fuel ratio, then unwanted emissions of NOx can occur as a result of oxidant saturation of the catalyst from a previous engine operating event, such as a previous tip-in event, elevated speed cruising event, and lean deceleration, thereby degrading emission control.

SUMMARY OF INVENTION

The present invention provides a method and control system for controlling an internal combustion engine of a vehicle where a catalyst is communicated to engine exhaust gas. The present invention involves predicting a future engine operating event that will change an exhaust gas constituent in the engine exhaust gases, determining an oxygen content in the exhaust gases downstream of the catalyst coupled to the engine, and adjusting an air/fuel ratio of the engine based on the determined oxygen content and the predicted engine operating event to precondition the catalyst prior to occurrence of the particular event in a manner to reduce the possibility of emissions when the event actually occurs.

In an illustrative embodiment of the invention, the air/fuel ratio in cylinders of an internal combustion engine is adjusted to provide an enriched air/fuel ratio in response to a prediction of an impending engine tip-in operating event where inducted air into the engine is increased and relatively increased NOx (oxidant) concentrations will be present in the exhaust gases. By so adjusting the air/fuel ratio based on the prediction of an impending tip-in event, the catalyst is preconditioned before the event occurs in a way to better handle the predicted increase in oxidants ($NO_x$) produced by the tip-in event.

In a particular embodiment of the invention, the impending tip-in event is predicted by determining whether the engine throttle is closed and whether vehicle speed is less than a predetermined calibrated vehicle speed value. If the throttle is closed and vehicle speed is below the calibrated value, the engine air/fuel ratio is adjusted using a modified fuel bias value obtained from a function that relates fuel adjustment (bias) values (as a function output) and exhaust gas oxygen sensor output voltages (as a function input) at a selected air mass. When an impending tip-in event is predicted, the exhaust gas oxygen sensor output voltage value that is input to the function is modified in a manner that will provide the modified fuel bias value to provide an enriched air/fuel ratio in the engine cylinders to precondition the catalyst for the impending tip-in event.

The present invention is advantageous to precondition a catalyst before a predicted, impending engine operating event occurs in a manner to reduce emissions and improve overall catalyst efficiency. The above and other advantages of the present invention will become more readily apparent from the following description taken with the following drawings.

BRIEF DESCRIPTION OF DRAWINGS

FIG. 5 is a look-up table to convert voltage of rear HEGO sensor to Indicated Lambda.

DETAILED DESCRIPTION

Figure 1:
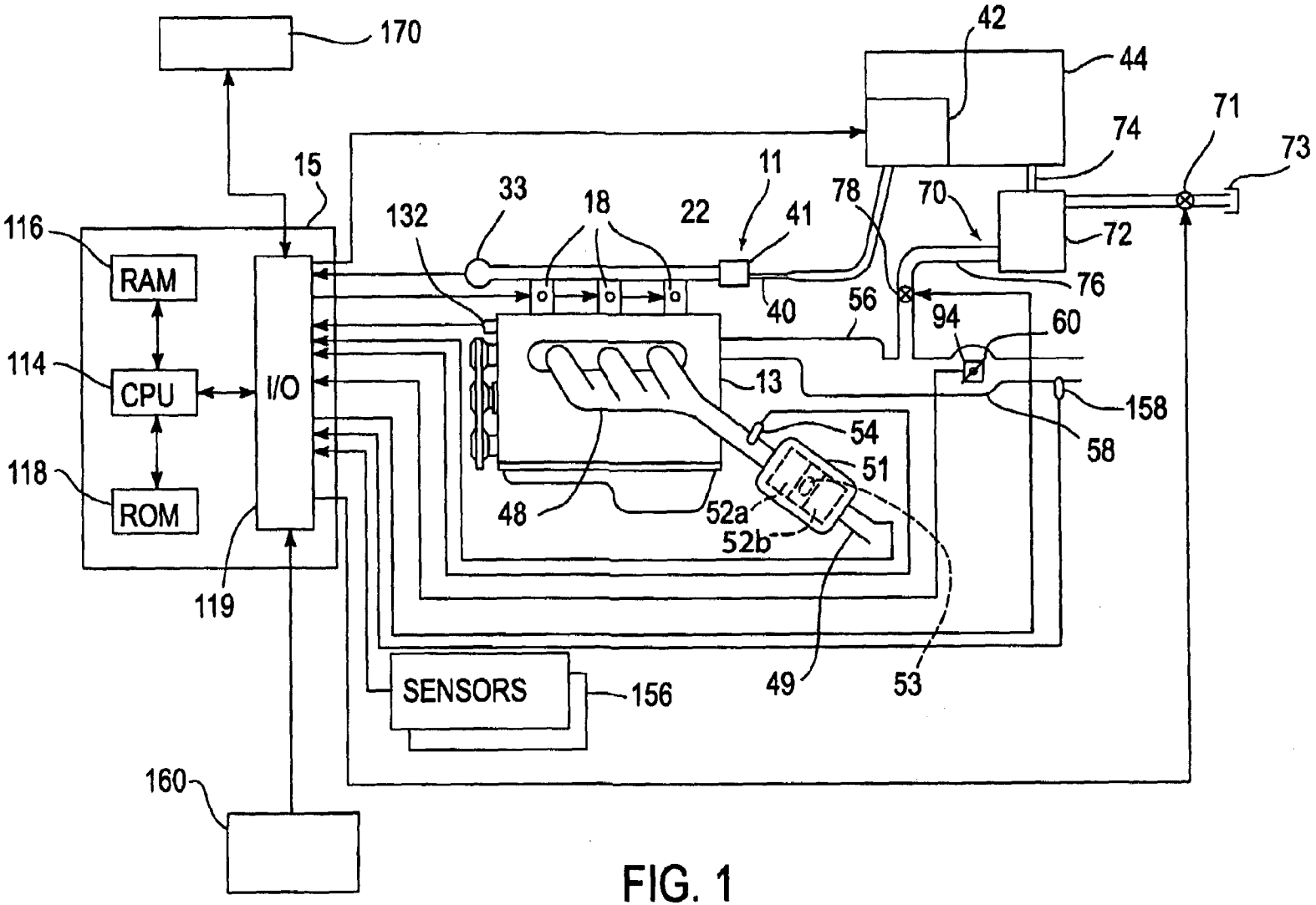
FIG. 1 is a block diagram illustrating an internal combustion engine and associated system components for practicing an illustrative embodiment of the invention.

FIG. 1 illustrates an exemplary internal combustion engine for practicing an embodiment of the invention. Fuel delivery system 11 of a conventional automotive internal combustion engine 13 is controlled by an electronic controller 15, such as an EEC (electronic engine control module) or PCM (powertrain control module). Engine 13 comprises fuel injectors 18, which are in fluid communication with fuel rail 22 to inject fuel into the cylinders (not shown) of engine 13, and temperature sensor 132 for sensing temperature of engine 13. Fuel delivery system 11 has fuel rail 22, fuel rail pressure sensor 33 connected to fuel rail 22, fuel line 40 coupled to fuel rail 22 via coupling 41, and fuel pump 42, which is housed within the fuel tank 44, to selectively deliver fuel to fuel rail 22 via fuel line 40.

Controller 15 includes CPU 114, random access memory 116 (RAM), computer storage medium 118 (ROM), having a computer readable code encoded therein, which can be a electronically programmable chip, and input/output (I/O) bus 120. Controller 15 controls engine 13 by receiving various inputs through I/O bus 120, such as fuel pressure in fuel delivery system 11 as sensed by pressure sensor 33; relative exhaust air/fuel ratio as sensed by pre-catalyst exhaust gas oxygen sensor 54 located upstream of catalytic converter 51 having catalyst 52 in the form of catalyst bricks 52*a*, 52*b* and post-catalyst exhaust gas oxygen sensor 53 located between catalyst bricks 52*a*, 52*b*; temperature of engine 13 as measured or inferred using temperature sensor 132; measurement of inducted air mass airflow (MAF) from mass airflow sensor 158; position of throttle 60 as sensed by throttle position sensor 94; engine speed (RPM) as sensed by conventional engine speed sensor 160; vehicle speed as sensed by conventional vehicle speed sensor 170; and various other sensors 156. Controller also creates various outputs through I/O bus 119 to actuate the various components of the engine control system. Such components include injectors 18, fuel delivery system 11, and vapor purge control valve 78.

Fuel pump 42, upon demand from engine 13 and under control of controller 15, pumps fuel from fuel tank 44 through fuel line 40, and into the pressure fuel rail 22 for distribution to the fuel injectors 18 during conventional engine operation. Controller 15 controls fuel injectors 18 to maintain a desired air/fuel ratio (A/F) ratio.

Engine also comprises exhaust manifold 48 coupled to exhaust ports (not shown) of the engine. A three-way catalytic converter 51 is communicated to exhaust manifold 48 and the engine exhaust gases therein. The catalytic converter 51 typically comprises a plurality of conventional catalyst bricks 52*a*, 52*b*, etc. disposed in the converter. First (front) exhaust gas oxygen sensor 54 is located upstream of catalytic converter 51, while second (rear) exhaust gas oxygen sensor 53 is located between catalyst bricks 52*a*, 52*b* or, alternatively, downstream of the catalytic converter 51 in the tail pipe 49. Exhaust gas oxygen sensors 53, 54 generate output voltage signals that represent oxygen content of the feed (exhaust) gas. The output voltage signals typically comprise a relatively low voltage when a lean engine operating condition exists and a relatively high voltage when a rich engine operating condition exists. The voltage signal from sensor 54 is indicative of the excursion of the air/fuel ratio in exhaust manifold 48 from stoichiometric. The exhaust gas oxygen sensors each typically comprises a conventional heated exhaust gas oxygen sensor (HEGO), although other known oxygen sensors such as conventional EGO and UEGO sensors can be used to practice the invention. HEGO sensors include heaters (not shown) for heating sensing tips of sensors 53, 54 to a sensor tip temperature higher than 350 to 400 degrees C. to activate the sensor element.

Engine 13 also comprises intake manifold 56 coupled to throttle body 58 having throttle 60 therein. Intake manifold 56 is also coupled to vapor recovery system 70, which comprises charcoal canister 72 communicated to fuel tank 44 via fuel tank connection line 74. Vapor recovery system 70 also includes a vapor purge control valve 78 positioned in intake vapor line 76 between intake manifold 56 and charcoal canister 72, which is controlled by signals from controller 15. Ambient air inlet vent 73 is connected to charcoal canister 72 such that air passing therethrough is controlled by inlet valve 71 in response to signals from the controller 15.

Figure 2:
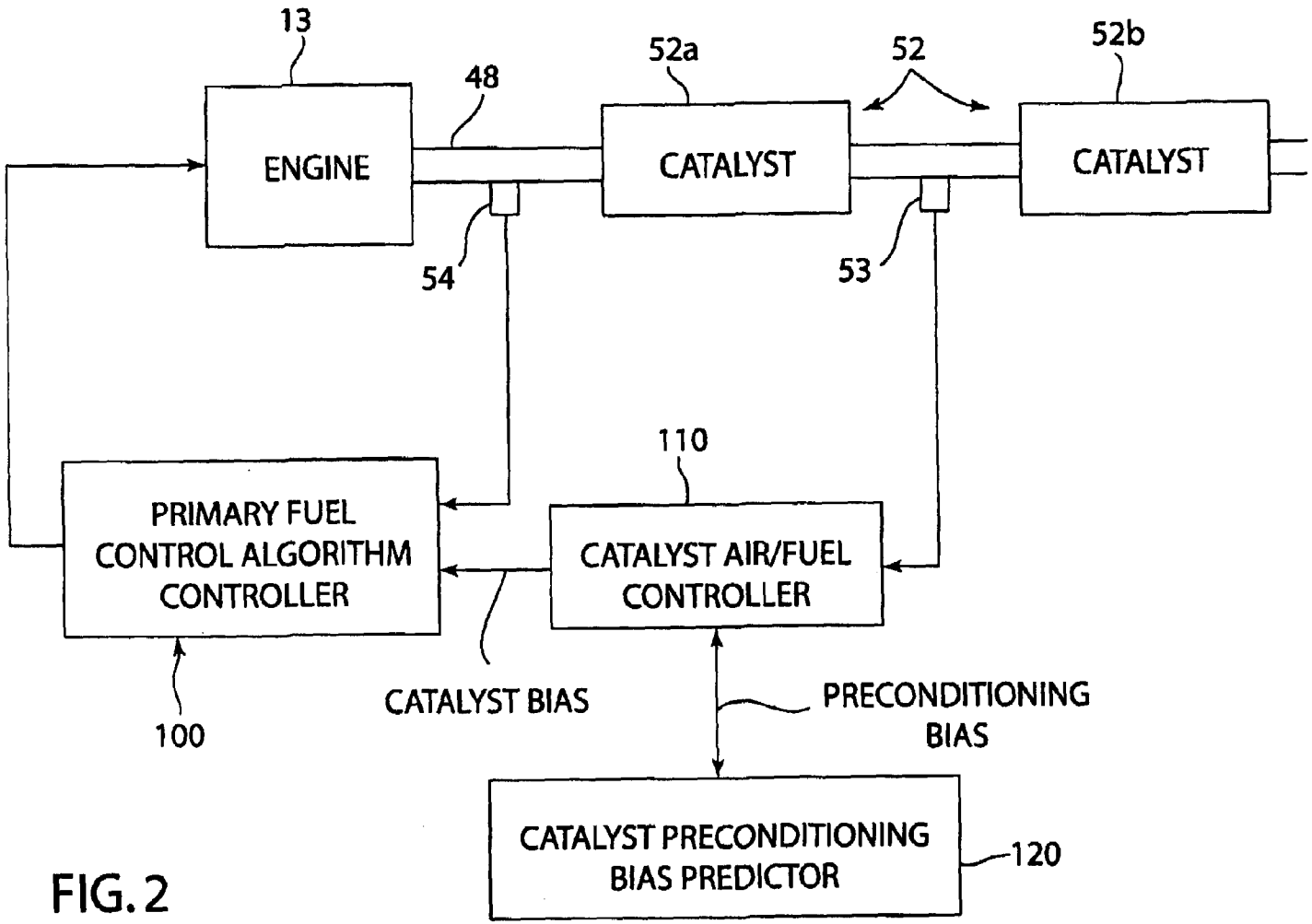
FIG. 2 is a block diagram of system components for practicing an illustrative embodiment of the present invention.
Figures 6A, 6B, 6C, 6D:
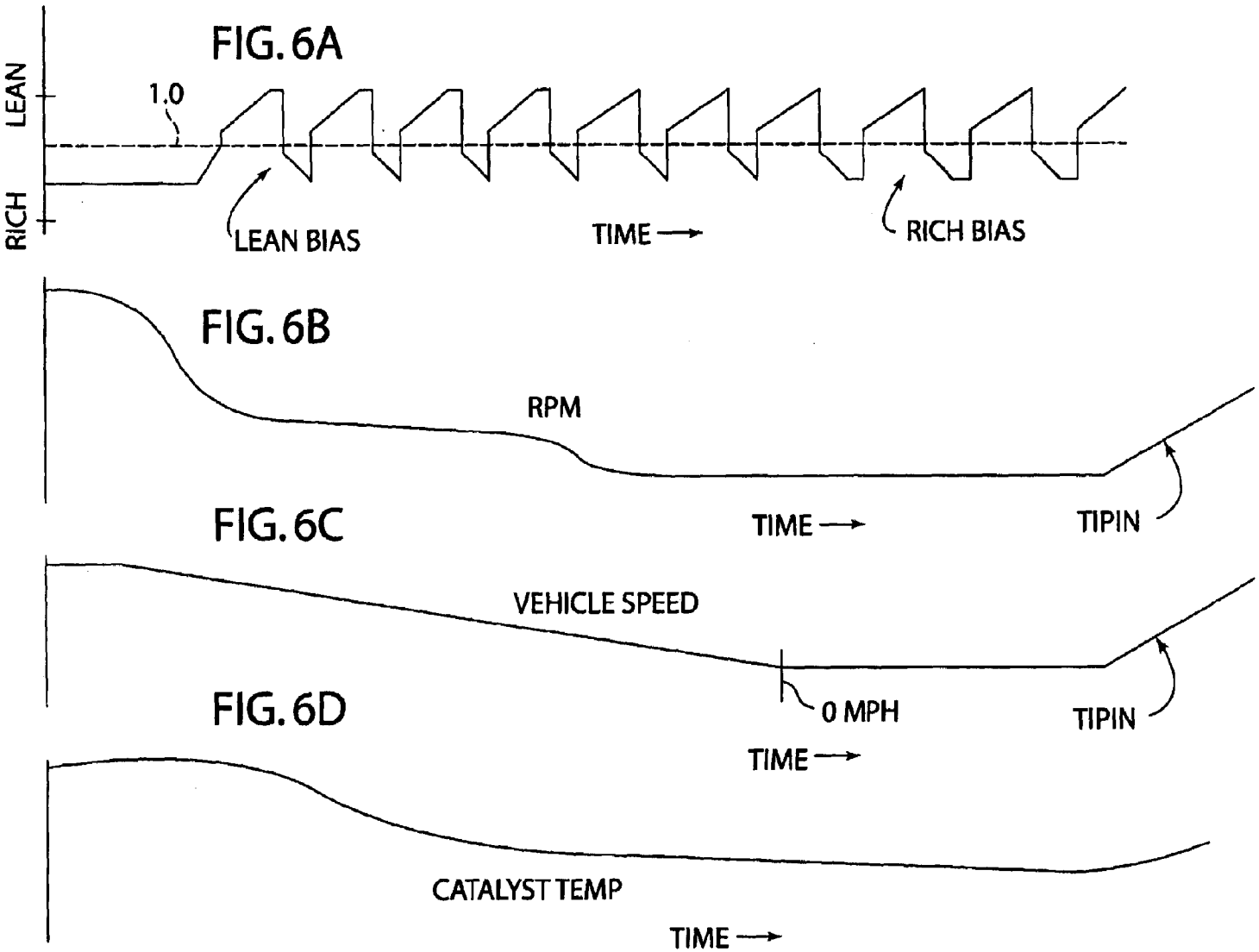
FIG. 6A is a graph illustrating fuel control waveform versus time during engine operating events.
FIG. 6B is a graph illustrating engine speed (RPM) versus time during engine operating events.
FIG. 6C is a graph illustrating vehicle speed versus time during engine operating events.
FIG. 6D is a graph illustrating catalyst temperature versus time during engine operating events.

To achieve improved efficiency of the catalytic converter 51, the condition (i.e. stoichiometric, lean-excess oxidants are present, or rich-excess reductants are present) of the engine air/fuel ratio is controlled based on catalyst requirements. To this end, a Primary Fuel Control Algorithm controller 100 and Catalyst Air/Fuel Controller 110, FIG. 2, are provided to control the amount of fuel delivered to the engine cylinders via the fuel injectors 18. The Primary Fuel Control Algorithm Controller 100 can be based on any assortment of algorithms including, but not limited to, proportional/integral algorithms, linear quadratic regulator algorithm, or proportional/integral derivative algorithm. For purposes of illustration and not limitation, the Primary Fuel Control Algorithm Controller 100 is of the type using proportional/integral algorithms that provide controller output waveform signals of the type illustrated in FIG. 6A to the fuel injectors 18 to control the amount of fuel injected into the engine cylinders. Such a method for controlling fuel delivery is described by D. R. Hamburg et al. in SAE Paper 800826.

In certain engine operating modes, such as for example during engine starting, the Primary Fuel Control Algorithm Controller 100 controls the engine based on upstream oxygen sensor 54, or engine operating conditions (e.g. engine temperature, engine load, engine air mass, ambient temperature, engine speed, etc.) in an open loop mode (e.g. using previously mapped operation strategy). The Catalyst Air/Fuel Controller 110 is not used at this time because the rear oxygen sensor 53 does not provide reliable information until a certain sensoroperating temperature has been reached. In particular, as the temperature of the exhaust gas increases, the Primary Fuel Algorithm Controller 100 uses the signals from the upstream oxygen sensor 54 to control the engine air/fuel ratio. When the rear oxygen sensor 53 has reached a temperature where it functions, (about 600 degrees F, the Catalyst Air/Fuel Controller 110 begins to work with the Primary Fuel Algorithm Controller 100 to this end.

The Primary Fuel Control Algorithm Controller 100 and the Catalyst Air/Fuel Controller 110 function together to reduce tailpipe emissions. The catalyst air/fuel controller 110 provides fuel bias or adjustment values to the Primary Fuel Control Algorithm Controller 100 to adjust the engine air/fuel ratio to ensure increased catalyst conversion efficiency. For example, in the illustrative embodiment, the primary engine air/fuel controller 100 functions in a proportional/integral configuration. If the rear oxygen sensor 53 senses a feed (exhaust) gas condition that represents a rich excursion or lean excursion of the desired engine air/fuel ratio, the Catalyst Air/Fuel Controller 110 provides a fuel bias or adjustment value to the Primary Fuel Control Algorithm Controller to adjust the engine air/fuel ratio that, in turn, adjusts the air/fuel ratio sensed at the catalyst back to a desired air/fuel ratio set point.

For example, each new commanded engine air/fuel ratio for the engine cylinders is carried out by controller 15 using a total fuel adjustment or bias (Bias_Gn) to drive the air fuel ratio toward the desired set-point (which may be the stoichiometric air fuel ratio). A total fuel bias (Bias_Gn) is determined as follows:

$$(Bias_Gn)=\text{Base Bias}+RBias_PROP+RBias_INT \quad (1)$$

where Base Bias is a calibrated value determined by Controller 100 from a look-up table as a function of engine speed and engine load, and where RBias_PROP and RBias_INT bias values are provided by the Catalyst Air/Fuel Controller 110. The RBias_PROP bias is a bias proportional gain term that is a function of inducted air mass (AM) and VEGO_BARn2 where VEGO_BARn2 is a temperature-compensated, software filtered value of the output voltage signal of rear oxygen sensor 53. The RBias_INT bias is a bias integral gain term that is a function of inducted air mass (am) and VEGO_BARn2. Use of this equation allows scheduling of fuel bias gain as a function of inducted air mass.

Each time a new commanded engine air/fuel ratio for the engine cylinders is to be determined by controller 15, the output signals from each of the exhaust gas oxygen sensors 53, 54 are examined. The voltage output values of each of the oxygen sensors 53, 54 are temperature compensated using respective voltage scaling functions to reflect the particular heated sensor tip temperature (designated EXT_REG) of each oxygen sensor 53, 54. The sensor temperature is determined by measurement or inference based on a previously determined model of sensor temperature. The voltage output value of oxygen sensor 53 is temperature compensated to provide a so-called Indicated Lambda value (Ind Lambda). The Indicated Lambda value is obtained from a look-up table having inputs of EXT_REG and VEGOn2 (raw oxygen sensor voltage) as shown FIG. 5 where the numbers in the Table are not actual data, but are offered for purposes of illustration only of calibrating the Indicated Lambda values. For example, in the Table of FIG. 5, each temperature of the sensor 53 has a unique voltage associated with Indicated Lambda equal to 1 (where Indicated Lambda of 1 represents a desired (e.g. stoichiometric) engine air/fuel ratio. For example, at 500 degrees F sensor temperature, the stoichiometric point is 0.7 volts, while at 842 degrees F., the stoichiometric point is 0.6 volts. The temperature-compensated voltage output signal value of oxygen sensor 53 is indicative of whether the exhaust gases have a relatively increased or decreased concentration of oxygen; i.e. whether the catalyst air/fuel ratio is lean or rich of stoichiometry.

The Indicated Lambda value of oxygen sensor 53 then is software filtered using low pass filtering and converted from analog to digital form to remove high frequency noise.

The filtered, digital Indicated Lambda value then is supplied to the Catalyst Air/Fuel Controller 110, which includes a proportional look-up table that outputs a proportional fuel bias value as a function of air mass (AM) and the Indicated Lambda value and an integral look-up table that outputs an integral fuel bias value as a function of air mass (AM) and the Indicated Lambda value. Each of the proportional table and the integral table of controller 100 has its own unique time constant to provide a filtered Indicated Lambda proportional value, designated Ind_Lambda_barP, to the proportional table and a filtered Indicated Lambda integral value, designated Ind_Lambda_barI, to the integral table. That is, the proportional bias gain value (RBias_PROP) is determined from the proportional table as a function of the inducted air mass (AM) and the Ind_Lambda_barP value, while the integral bias gain (RBias_INT) is determined from the integral table as a function of the inducted air mass (AM) and the Ind_Lambda_barI value. The RBias_PROP fuel bias value and the RBias_INT bias value thus are determined by Catalyst Air/Fuel Controller 110 based on a selected engine operating parameter; namely, inducted air mass which is related to engine load and engine speed (e.g. AM=load*speed*constant).

Figure 3:
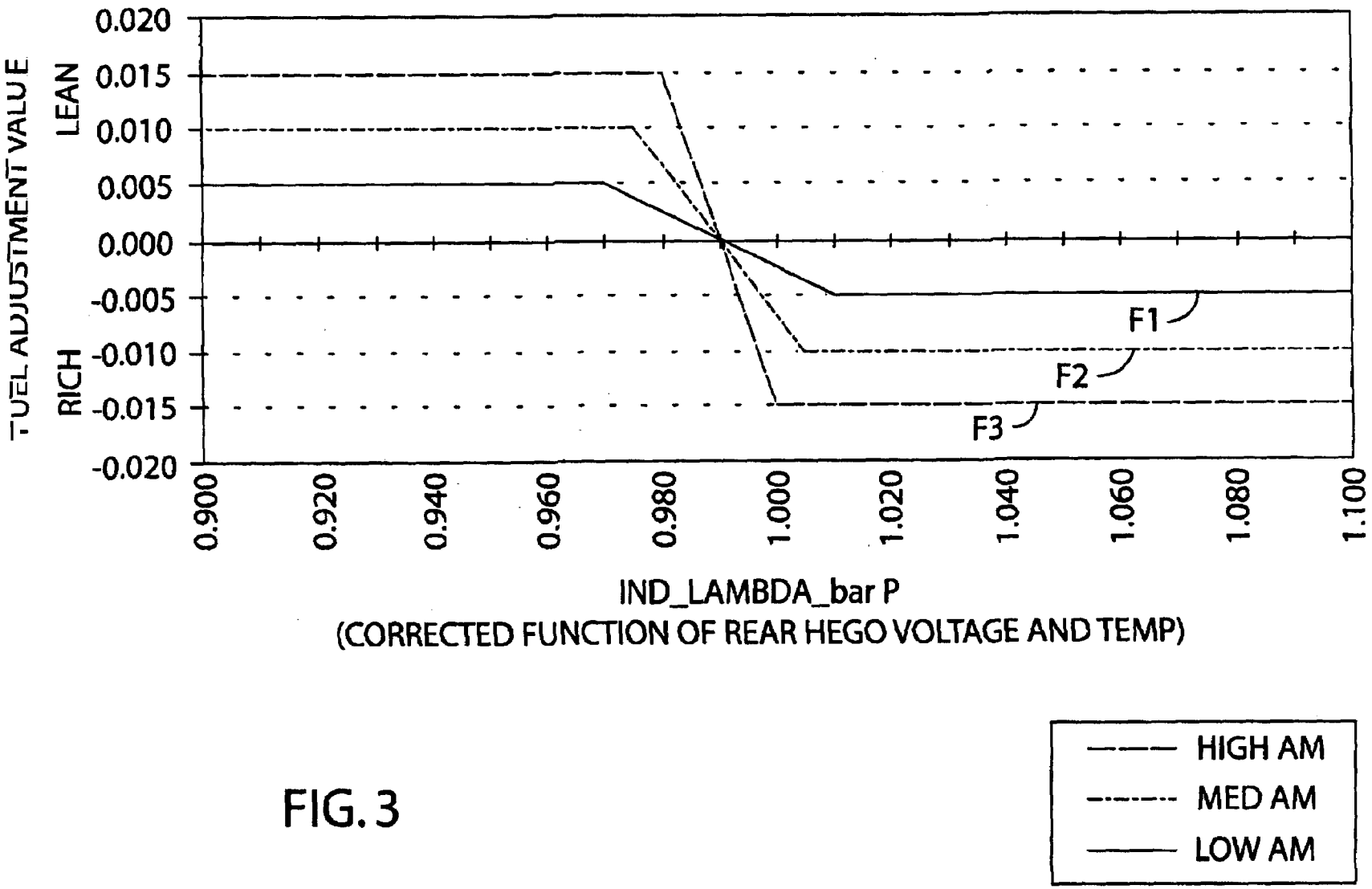
FIG. 3 is an illustrative graph of a function that relates fuel adjustment (bias) values (as a function output) and temperature-compensated, filtered oxygen sensor output values (as a function input) at low, medium and high inducted engine air mass.

Exemplary fuel adjustment (bias) functions are shown in FIG. 3 and are representative of some of the proportional fuel adjustment (bias) functions stored in the proportional table of Catalyst Air/Fuel Controller 110. The fuel adjustment functions are shown in FIG. 3 in the form of graphical functions F1, F2, F3 determined at low, medium, and high air mass as determined empirically from engine test stand data. The fuel adjustment or bias functions of the integral table of Catalyst Air/Fuel Controller 110 can be represented in similar manner as shown in FIG. 3. Use of such proportional and integral functions or tables requires that the functions or tables have the same zero bias crossing.

For purposes of illustration and not limitation, the indices to the fuel adjustment functions of FIG. 3 are (1) air mass, such as low, medium, and high air mass associated with low, medium, and high engine load, respectively, and (2) Indicated Lambda (IND LAMBDA) which is the temperature-compensated, low pass filtered voltage output signal value of oxygen sensor 53 representing oxygen content in the exhaust gases downstream of catalyst brick 52*a*. Use of such functions allows the controller 15 to apply a greater fuel adjustment or bias if the engine load is high, and vice versa, even though the Indicated Lambda value may be the same at different engine loads.

The Indicated Lambda value of oxygen sensor 53 is used by Catalyst Air/Fuel Controller 110 to determine fuel adjustment or bias values (RBias_PROP and RBias_INT). Generally, if the voltage output signal of oxygen sensor 53 indicates a relatively high concentration of oxygen in the exhaust gases, then the Controller 110 will determine Catalyst Bias values that tend to cause the engine air/fuel ratio to be more rich. Conversely, if the voltage output signal of oxygen sensor 53 indicates a relatively low concentration of oxygen in the exhaust gases, then the Controller 110 will determine Catalyst Bias values that tend to cause the engine air/fuel ratio to be more lean. The Catalyst Bias output of Controller 110 (RBias_PROP and RBias_INT) is provided to the Primary Fuel Control Algorithm Controller 100. A Catalyst Preconditioning Bias determined pursuant to the invention as described below is provided to the Catalyst Air/Fuel Controller 110 when Catalyst Preconditioning Bias Predictor 120 predicts that an engine operating event is impending that will change an exhaust gas constituent in the exhaust gases.

Also provided to the Primary Fuel Control Algorithm Controller 100 is a temperature-compensated, filtered, analog-to-digitalconverted voltage output ssignal of pre-catalyst oxygen sensor 54. The raw voltage output signal of oxygen sensor 54 is temperature-compensated, low pass filtered, and analog-to-digital converted in a manner similar to that described above for the raw voltage output signal of oxygen sensor 53. For purposes of illustration and not limitation, a comparator (not shown) compares the temperature-compensated, software filtered, analog-to-digitalconverted voltage output signal of upstream oxygen sensor 54 to a pre-catalyst set point reference value to determine an error value. Typically, the pre-catalyst set point is a function of engine speed and load. The pre-catalyst error value is indicative of whether the air/fuel ratio in the exhaust manifold 48 is relatively rich or lean. This pre-catalyst error value is used to determine if the air/fuel ratio has from a rich-to-lean or lean-to-rich. If the air/fuel ratio has switched, the calculated fuel amount is delivered to the engine in a near instantaneous so-called jump back mode. If the air/fuel ratio has not switched but is following a previous rich or lean trend, the calculated fuel amount is delivered in a ramp mode over time as determined by the waveform signals output by the Primary Fuel Control Algorithm Controller 100. For purposes of illustration, the Primary Fuel Control Algorithm Controller 100 generates waveform signals of the type shown in FIG. 7A in response to the Catalyst Bias values to control the amount of fuel injected by fuel injectors 18 into the engine cylinders to control the engine air/fuel ratio that, in turn, controls the condition (stoichiometric, lean or rich) of the feed (exhaust) gas.

Pursuant to the present invention, the above-mentioned Preconditioning Bias is provided to Controller 110 in response to a prediction that an engine operating event that will result in a change in an exhaust gas constituent in the engine exhaust gases (e.g. an oxidant increase) is impending so as to adjust the Catalyst Bias value of the Controller 110 in a manner to achieve adjustment of the air/fuel ratio in engine cylinders prior to the expected event to precondition the catalyst to better handle the event and reduce emissions when the event actually occurs. For example, the Catalyst Bias value is modified to adjust a fuel injection amount into the engine cylinders before the event occurs to provide an enriched air/fuel ratio for a predicted oxidant-increasing engine event so as to precondition the catalyst prior to occurrence of the particular event in a manner to reduce the possibility of emissions when the event actually occurs.

As background, three-way catalytic converter 51 is a gas-converting device, which has oxygen storage capability. If the controller 15 operates the engine 13 slightly lean for a period of time, the catalyst 52 will absorb oxygen until it saturates with oxygen. The catalyst holds the stored oxygen until hydrogen or carbon atoms from engine exhaust gases react with the oxygen. When the catalyst saturates with oxygen, the rear oxygen sensor 53 will reveal this condition with a lean voltage output signal (e.g. 0.2 volts or less in the usual 0.0 to 1.0 voltage range for a HEGO sensor) known as a lean breakthrough. Should the next engine operating event produce increased NOx concentrations in the engine exhaust gases and should the engine air/fuel ratio be controlled at a lean condition, then an undesirable NOx breakthrough (NOx emissions) is likely to occur since there is little or no catalyst capability to absorb further NOx.

When the catalyst 52 is completely depleted of oxygen, the rear oxygen sensor 53 will reveal this condition with a voltage output signal (e.g. 0.7 volts or greater for HEGO sensor). Should the next engine operating event produce high HC concentrations in the engine exhaust gas and should the engine air/fuel ratio be controlled to a rich condition, then an undesirable HC breakthrough (HC emissions) is likely to occur since there is little or no catalyst oxygen to react with the HC.

A predictable engine operating event of interest in practice of the invention includes, but is not limited to, a so-called impending tip-in operating event that occurs at relatively elevated engine loads (e.g. vehicle acceleration from stop or near stop) where inducted air into the engine is increased and relatively elevated NOx concentrations are present in the engine exhaust gases. FIGS. 6A through 6D illustrate engine operation including such a tip-in event and exemplary waveform signals generated by the Primary Fuel Control Algorithm Controller 100 during typical engine operation. FIGS. 6A through 6D start in time at the left region with the engine under increased speed/load conditions. Since the catalyst temperature is increased during elevated speed/load operation, the engine is being enriched (rich Catalyst Control Bias) so that the catalyst temperature does not increase over a preselected maximum catalyst temperature. When the driver of the vehicle tips out (decelerates), the engine speed falls and the catalyst temperature remains elevated for a time, but begins to decrease due to the decrease in demanded engine speed/load. Since the catalyst has been biased rich, due to the fuel enrichment, catalyst efficiency is relatively low. Knowing that the catalyst is enriched and that the decreasing engine speed/load will cool the catalyst, a lean air/fuel bias is provided by the Primary Fuel Control Algorithm Controller 100 as a result of a lean Catalyst Control Bias value being added to the Base Bias. The lean bias is provided until the catalyst cools to a desired temperature or until the driver tips back into the throttle (accelerates) or until the rear oxygen sensor 53 indicates a lean condition.

The center region of FIGS. 6A through 6D illustrates the vehicle slowing down with no rich or lean bias being requested. The right region of FIGS. 6A through 6D illustrates the vehicle reaching zero speed, the catalyst cool, RPM at idle speed (throttle closed), and a rich air/fuel bias being provided by the Primary Fuel Control Algorithm Controller 100 (as a result of a rich Catalyst Bias value being added to the Base Bias) in anticipation of an impending tip-in event pursuant to the invention. The rich air/fuel bias is provided to precondition the catalyst 52 to better handle the anticipated tip-in event, which represents an oxidant-increasing ($NO_x$) engine event. In particular, higher engine load associated with the anticipated tip-in event will produce elevated in-cylinder gas temperature and pressure, increasing NOx concentrations in the exhaust gases. By so adjusting the air/fuel ratio based on the prediction of an impending tip-in event, the catalyst 52 is preconditioned in a way to better handle the increased $NO_x$ associated with the elevated in-cylinder gas temperatures and pressures generated by the tip-in event. That is, the oxidant (oxygen and NOx) level of the catalyst is reduced to minimize the chance of oxidant saturation in the catalyst when the impending tip-in event subsequently occurs. By moving the air/fuel ratio average toward a richer ratio, additional CO can be stored in the catalyst for subsequent reaction with the $NO_x$ when the tip-in event occurs. Preconditioning of the catalyst 52 in this manner will help avoid the possibility of unwanted $NO_x$ emissions.

Figures 7A, 7B, 7C, 7D:
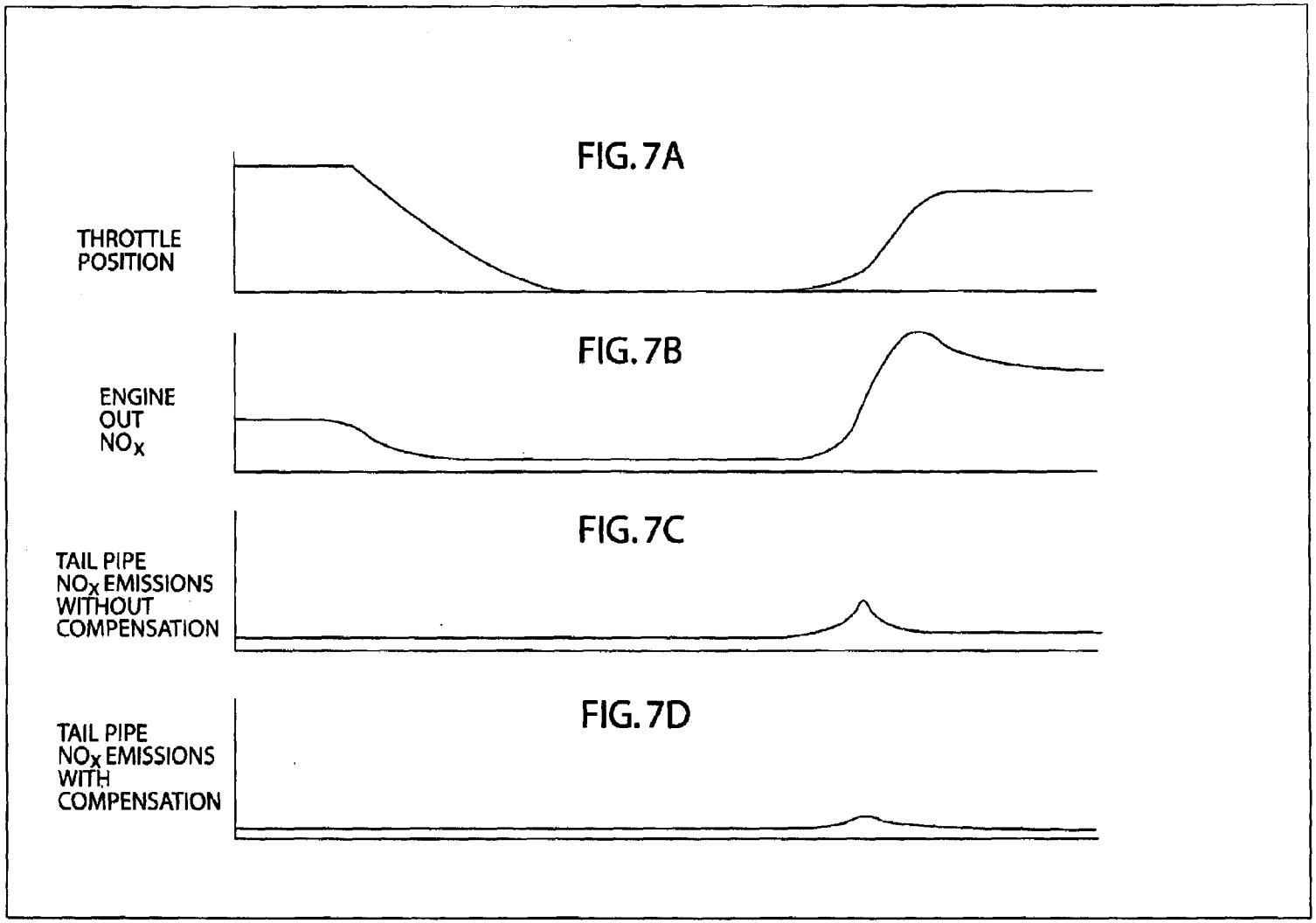
FIG. 7A is a graph of engine throttle position versus time on the horizontal axis of the figure where throttle opening increases as one progresses upwardly along the vertical axis of the figure.
FIG. 7B is a graph of engine output NOx versus time on the horizontal axis of the figure where NOx increases as one progresses upwardly along the vertical axis of the figure.
FIG. 7C is a graph of tailpipe emissions without catalyst preconditioning or compensation pursuant to the invention versus time on the horizontal axis of the figure where emissions increase as one progresses upwardly along the vertical axis of the figure.
FIG. 7D is a graph of tailpipe emissions with catalyst preconditioning or compensation pursuant to the invention versus time on the horizontal axis of the figure where emissions increases as one progresses upwardly along the vertical axis of the figure.

FIG. 7A illustrates changes in engine throttle position versus time (on the horizontal axis of the figure) and the corresponding changes in engine output NOx over that time period. FIG. 7C is a graph of tailpipe emissions without catalyst preconditioning or compensation pursuant to the invention over that time period. FIG. 7D is a graph of tailpipe emissions over that time period with catalyst preconditioning or compensation pursuant to the invention. The reduction in NOx emissions by practice of the invention is apparent by comparing FIG. 7D with FIG. 7C.

Figure 4:
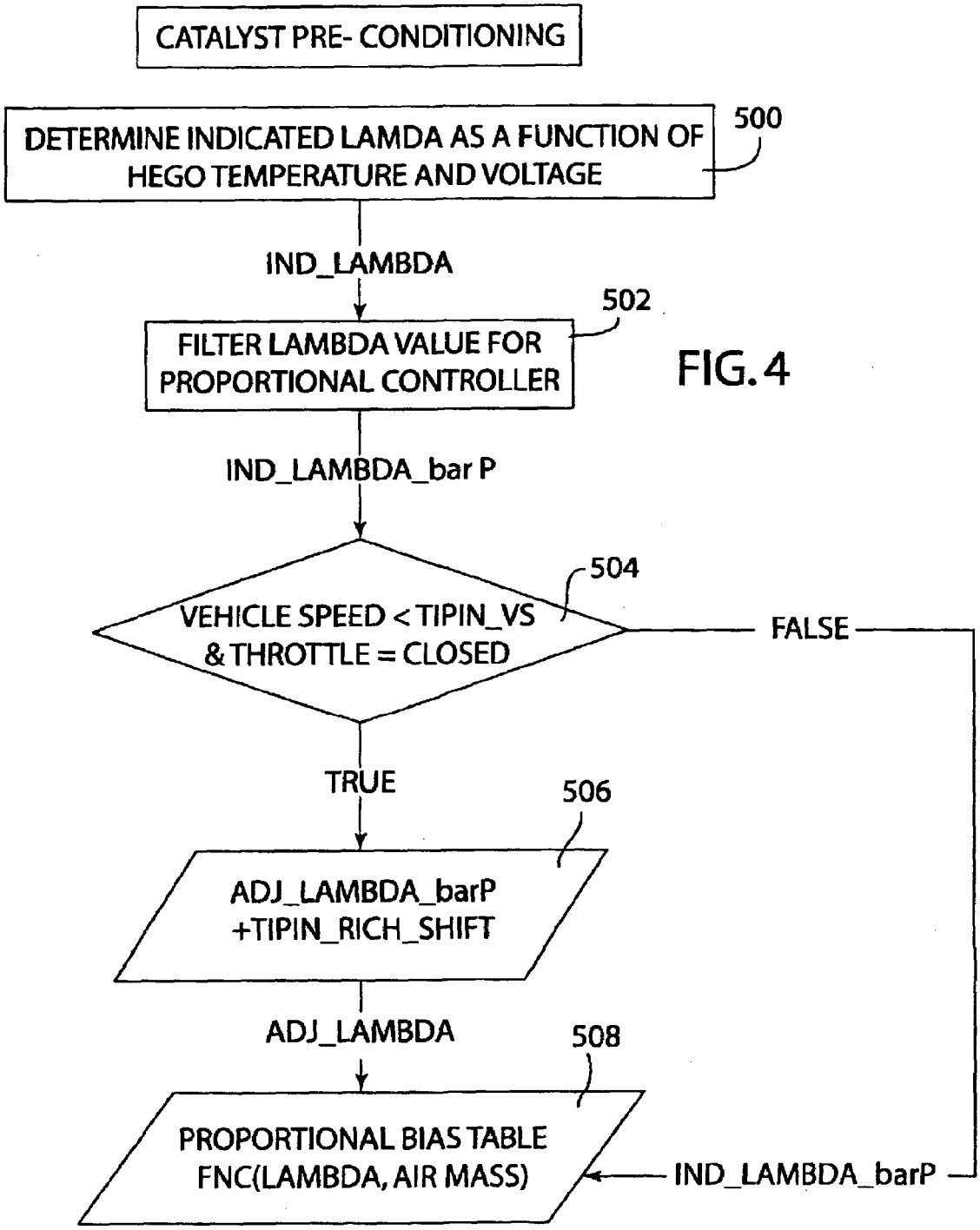
FIG. 4 is a flow chart for practicing an illustrative embodiment of the invention.

FIG. 4 provides an exemplary flowchart for practicing an illustrative embodiment of the present invention using the Catalyst Air/Fuel Controller 110 and the Catalyst Preconditioning Bias Predictor 120.

In block 500, the Indicated Lambda (IND_LAMBDA) value is determined as a function of HEGO temperature and voltage as explained above. In block 502, the Indicated Lambda value is filtered by a low pass software filter to reduce high frequency noise as explained above. The filtered Indicated Lambda value (designated IND_LAMBDA_barP) then is ready to be provided to proportional-integral Catalyst Air/Fuel Controller. In block 504, the Catalyst Preconditioning Bias Predictor 120 determines if entry (prerequisite) conditions exist where the throttle 60 is closed (engine at or near idle) and the vehicle speed is less than the predetermined calibrated vehicle speed value, TIPIN_VS. For purposes of illustration and not limitation, the predetermined calibrated vehicle speed value can be 5 miles per hour or less.

If the throttle 60 is closed and vehicle speed is below the calibrated TIPIN_VS value, the flowchart proceeds to block 506 where the IND_LAMBDA_barP value is modified by adding a TIPIN_RICH_SHIFT value to provide an ADJ_LAMBDA value. The TIPIN_RICH_SHIFT value corresponds to the Preconditioning Bias value, FIG. 2, when a tip-in event is anticipated. The ADJ_LAMBDA value is used as the input to the proportional bias table of Controller 110. In particular, in block 508, the ADJ_LAMBDA value is input to the air mass function F1 of the proportional bias table, FIG. 3, to provided a modified fuel bias value (RBias_PROP). As a result, the Controller 110 outputs a modified Catalyst Bias value to Primary Fuel Control Algorithm Controller 100 for use in closed loop fuel calculation performed by the Primary Fuel Algorithm Controller 100. The input (IND_LAMBDA_barI) to the integral bias table of Controller 110 is not adjusted but remains at past value when the tip-in event is predicted and while the IND_LAMBDA_barP value is modified.

For purposes of further illustration and not limitation, with respect to FIG. 4, the TIPINmay be selected to be a 0.01 calibration constant as determined empirically from engine test data to provide the desired rich air/fuel ratio in the engine cylinders for catalyst pre-conditioning if a tip-in event is anticipated. Thus, if a tip-in event is anticipated in block 504 of FIG. 4, the TIPIN_RICH_SHIFT value of 0.01 is added to the particular IND_LAMBDA_barP to provide ADJ_LAMBDA, which is used as the input to low air mass function F1 of FIG. 3. For example, if INDis equal to 0.99, then the TIPIN_RICH_SHIFT value of 0.01 is added to the IND_LAMBDA_barP value to provide a modified lambda value, ADJ_LAMBDA, of 1.0 as the input to low air mass function F1 of FIG. 3. In effect, use of the ADJ_LAMBDA value as the input to low air mass function F1 of FIG. 3 shifts the set point of that function F1.

The ADJ_LAMBDA value is converted using the low air mass function F1 of FIG. 3 to provide a proportional fuel adjustment (bias) value for RBias_PROP of −0.0025. This value will be provided along with the RBias_INT value (that is determined under similar operating conditions, but where compensation for a tip-in event is not provided) to the Primary Fuel Control Algorithm Controller 100 to provide an enriched air/fuel ratio to precondition the catalyst 52 for the impending tip-in event. Thus, when a tip-in event (representing an oxidant-increasing ($NO_x$) engine event) is anticipated, the Catalyst Bias value is modified to provide an enriched bias (increase in fuel injection amount). In contrast, when a tip-in event is not predicted (FALSE decision in block 504), the unmodified value of IND_LAMBDA_barP is input to the functions of FIG. 3 as illustrated with respect to block 504—FALSE of FIG. 4.

The present invention thus is advantageous to precondition catalyst 52 for a predicted, impending engine operating event in a manner to reduce emissions and improve overall catalyst efficiency. While the invention has been described in terms of specific embodiments, those skilled in the art will appreciate that various modified and alternative embodiments for practicing the invention are possible as defined in the following claims.

What is claimed is:

1. A method of controlling an internal combustion engine of a vehicle, the engine communicating exhaust gases to a catalyst, the method comprising:

predicting a future engine operating event that will change an exhaust gas constituent in the engine exhaust gases;

measuring an oxygen sensor in exhaust gases downstream of the catalyst coupled to the engine, and adjusting said measurement based at least on a temperature of said oxygen sensor; and adjusting an air-fuel ratio of the engine based on said adjusted measurement and said predicted engine operating event.

2. The method of claim 1 wherein said future engine operating event is an increase in inducted air into the engine.

3. The method of claim 2 wherein said adjusting step includes enriching said air-fuel ratio prior to said increase in inducted air.

4. The method of claim 1 wherein said exhaust gas constituent is NOx.

5. The method of claim 4 wherein said predicting step includes determining that Nox concentrations in the exhaust gases will be increasing due to the future engine event.

6. The method of claim 5 wherein said fuel enrichment reduces the oxidant level of the catalyst.

7. The method of claim 1 wherein said event is predicted by determining whether an engine throttle is closed and whether a vehicle speed is below a predetermined calibrated vehicle speed value.

8. A system for controlling an internal combustion engine of a vehicle, the engine communicating exhaust gases to a catalyst, the system comprising:

an exhaust gas oxygen sensor disposed downstream of the catalyst generating a first signal; and a controller receiving said first signal, said controller configured to adjust said first signal based at least on a temperature of said exhaust gas oxygen sensor, and to predict a future engine operating event that will change an exhaust gas constituent in the engine exhaust gases, said controller further configured to adjust an air-fuel ratio of the engine based on said adjusted first signal and said predicted engine operating event.

9. The system of claim 8 wherein said future engine operating event is an increase in inducted air into the engine.

10. The system of claim 9 wherein said controller is further configured to enrich said air-fuel ratio prior to said increase in inducted air.

11. The system of claim 8 wherein said exhaust gas constituent is NOx.

12. An article of manufacture, comprising:

a computer storage medium having a computer program encoded therein for controlling an internal combustion engine communicating exhaust gases to a catalyst, the computer storage medium comprising:

code for predicting a future engine operating event that will change an exhaust gas constituent in the engine exhaust gases;

code for measuring an oxygen sensor in exhaust gases downstream of the catalyst coupled to the engine, adjusting said measurement based at least on a temperature of said oxygen sensor; and code for adjusting an air-fuel ratio of the engine based on said oxygen content and said predicted engine operating event.

13. A method of controlling an internal combustion engine of a vehicle, the engine communicating exhaust gases to a catalyst, the method comprising a first mode of operation wherein a first oxygen sensor located upstream of at least a catalyst determines a first air-fuel mixture of said internal combustion engine, and wherein a second oxygen sensor is located downstream of said at least a catalyst, and wherein a controller adjusts a first engine fuel amount based on said first oxygen sensor and not based on said second sensor;

a second mode of operation wherein said upstream oxygen sensor determines a second air-fuel mixture of said internal combustion engine, and wherein a future engine operating event that will change an engine exhaust gas constituent in the engine exhaust gases is predicted, and wherein an oxygen content downstream of a catalyst coupled to said engine is determined, and wherein said controller adjusts a second engine fuel amount based at least on said determined second air-fuel mixture, said predicted future engine operating events and said downstream oxygen content; and operating in said first mode during a first temperature of said second oxygen sensor, and operating in said second mode of operation during a second temperature of said second oxygen sensor.

14. The method of claim 13 wherein said future engine operating event is an increase in inducted air into said engine.

15. The method of claim 13 wherein said adjusted second fuel amount is enriched prior to said future engine operating event.

16. The method of claim 13 wherein said exhaust gas constituent is NOx.

* * * * *